US007041938B2

(12) United States Patent
Kumada et al.

(10) Patent No.: US 7,041,938 B2
(45) Date of Patent: May 9, 2006

(54) GLOW PLUG, GLOW PLUG MOUNTING STRUCTURE, AND GLOW PLUG MANUFACTURING METHOD

(75) Inventors: Chiaki Kumada, Gifu (JP); Shunsuke Gotou, Ichinomiya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 51 days.

(21) Appl. No.: 10/481,082

(22) PCT Filed: Jun. 12, 2002

(86) PCT No.: PCT/JP02/05854

§ 371 (c)(1),
(2), (4) Date: Dec. 17, 2003

(87) PCT Pub. No.: WO02/103243

PCT Pub. Date: Dec. 27, 2002

(65) Prior Publication Data

US 2004/0188408 A1 Sep. 30, 2004

(30) Foreign Application Priority Data

Jun. 19, 2001 (JP) ..... 2001-185196

(51) Int. Cl.
*F23Q 7/22* (2006.01)

(52) U.S. Cl. ..... 219/270; 219/544; 29/615

(58) Field of Classification Search ..... 219/270, 219/544; 123/145 A, 145 R; 29/611, 614

See application file for complete search history.

(56) References Cited

U.S. PATENT DOCUMENTS 5,172,664 A * 12/1992 Mueller et al. ..... 123/145 A
6,064,039 A * 5/2000 Kumada ..... 219/270

FOREIGN PATENT DOCUMENTS

| | | |
|---|---|---|
| JP | 63-44064 U | 3/1988 |
| JP | 1-74463 U | 5/1989 |
| JP | 7-151331 | 6/1995 |
| JP | 9-257251 | 9/1997 |
| JP | 11-294768 | 10/1999 |
| JP | 2000-97434 | 4/2000 |
| JP | 2000-220828 | 8/2000 |
| JP | 2001-41452 | 2/2001 |

* cited by examiner

*Primary Examiner*—Teresa J. Walberg
(74) *Attorney, Agent, or Firm*—Morgan Lewis & Bockius LLP

(57) ABSTRACT

To provide a glow plug capable of speedily increasing the temperature, a glow plug mounting structure, and a process for manufacturing the glow plug.

In the invention, the glow plug (1) comprises: a cylindrical sheath tube (3) closed at its front end 3S) and opened at its base end (3K); a cylindrical metal shell (5) covering the side of the base end (3K); a heating coil (7) arranged in the sheath tube (3) along the axis thereof and connected at its front end portion (7S) to the front end (3S) of the sheath tube (3); and insulating powder (11) packed in the sheath tube (3). The front end side portion (7H) of the heating coil (7) farther than the foremost end (9T) of the lead member (9) has a coil length not larger than 15 mm in the axial direction from the front end (3S) of the sheath tube (3). The sheath front end portion (3C) enclosing the front end side portion (7H) has an outer diameter not larger than 4.4 mm.

12 Claims, 15 Drawing Sheets

FIG. 6

| | COIL LENGTH L (mm) | FRONT END PORTION OUTER DIAMETER D (mm) | NORMAL TEMPERATURE RESISTANCE VALUE R (mm) | 1,000 °C ATTAINABLE TIME T (SECOND) | ENDURANCE CYCLE NUMBER (TIMES) |
|---|---|---|---|---|---|
| EMBODIMENT 1 | 11 | 3.5 | 0.81 | 3.2 | 8000 |
| EMBODIMENT 2 | 8 | 3.5 | 0.79 | 1.9 | 12000 |
| EMBODIMENT 3 | 15 | 3.5 | 0.80 | 5.0 | 6000 |
| EMBODIMENT 4 | 8 | 3.5 | 0.70 | 1.5 | 10000 |
| EMBODIMENT 5 | 8 | 4.4 | 0.80 | 3.3 | 10000 |
| COMPARATIVE EXAMPLE 1 | 20 | 3.5 | 0.80 | 5.8 | 2000 |
| COMPARATIVE EXAMPLE 2 | 8 | 5.0 | 0.80 | 5.7 | 5000 |

FIG. 7

| | COIL LENGTH L (mm) | FRONT END PORTION OUTER DIAMETER D (mm) | NORMAL TEMPERATURE RESISTANCE VALUE R (mm) | 1,000 °C ATTAINABLE TIME T (SECONDS) | ENDURANCE CYCLE NUMBER (TIMES) | LEAD LENGTH L2 (mm) | ELECTRIC TERMINAL SHAFT DIAMETER H (mm) | BEND OF SHEATH TUBE |
|---|---|---|---|---|---|---|---|---|
| EMBODIMENT 1 | 11 | 3.5 | 0.81 | 3.2 | 8000 | 8 | 2.0 | GOOD |
| EMBODIMENT 2 | 8 | 3.5 | 0.79 | 1.9 | 12000 | 8 | 2.0 | GOOD |
| EMBODIMENT 3 | 15 | 3.5 | 0.80 | 5.0 | 6000 | 8 | 2.0 | GOOD |
| EMBODIMENT 4 | 8 | 3.5 | 0.70 | 1.5 | 10000 | 8 | 2.0 | GOOD |
| EMBODIMENT 5 | 8 | 4.4 | 0.80 | 3.3 | 10000 | 8 | 2.4 | GOOD |
| EMBODIMENT 6 | 8 | 3.5 | 0.79 | 2.0 | 12000 | 8 | 1.0 | EVEN |
| EMBODIMENT 7 | 8 | 3.5 | 0.79 | 3.6 | 12000 | 3 | 2.0 | GOOD |
| EMBODIMENT 8 | 8 | 3.5 | 0.79 | 3.7 | 12000 | 3 | 1.0 | EVEN |
| COMPARATIVE EXAMPLE 1 | 20 | 3.5 | 0.80 | 5.8 | 2000 | 8 | 2.0 | GOOD |
| COMPARATIVE EXAMPLE 2 | 8 | 5.0 | 0.80 | 5.7 | 5000 | 8 | 2.5 | GOOD |
| COMPARATIVE EXAMPLE 3 | 20 | 3.5 | 0.79 | 6.0 | 2000 | 8 | 1.0 | EVEN |
| COMPARATIVE EXAMPLE 4 | 20 | 3.5 | 0.79 | 6.5 | 2000 | 3 | 2.0 | GOOD |

● : ELECTRIC TERMINAL SHAFT H = 2.0mm (ϕ)
△ : ELECTRIC TERMINAL SHAFT H = 1.0mm (ϕ)

COMMON CONDITIONS
FRONT END PORTION OUTER DIAMETER D = 3.5mm (ϕ)
NORMAL TEMPERATURE RESISTANCE VALUE R = 7.9-8.0 (Ω)
LEAD LENGTH L2 = 8.0mm

| COMMON CONDITIONS |
|---|
| COIL LENGTH L = 8.0mm |
| NORMAL TEMPERATURE RESISTANCE VALUE R = 7.9-8.0 Ω |
| LEAD LENGTH L2 = 8.0mm |
| ELECTRICTERMINAL SHAFT L H = 2.0mm ϕ |

GLOW PLUG, GLOW PLUG MOUNTING STRUCTURE, AND GLOW PLUG MANUFACTURING METHOD

TECHNICAL FIELD

The present invention relates to a glow plug used to preheat a diesel engine and for other purposes, a structure for mounting the glow plug, and a process for manufacturing the glow plug.

BACKGROUND ART

Various modes of glow plugs used to preheat a diesel engine and for other purposes have heretofore been known in the related art. A glow plug 101, a general view and a longitudinal sectional view of which are shown in FIG. 13 and FIG. 14, respectively, is included as an example of the known glow plugs. This glow plug 101 is provided with a cylindrical sheath tube 103 closed at its front end 103S and opened at its base end 103K, and a cylindrical metal shell 105 covering the sheath tube 103 on the side of the base end 103K. Of these parts, the sheath tube 103 projects, at its portion having a length of about 36 mm from its front end 103S, from the front end of the metal shell 105, and an outer diameter of this portion of the sheath tube is at a uniform value of 5.0 mm.

Inside of the sheath tube 103, a heating coil 107 is arranged along the axis of the sheath tube 103, as shown in the partial enlarged sectional view of FIG. 15. A front end portion 107S of this heating coil 107 is electrically connected with the front end 103S of the sheath tube 103. Into the portion of the sheath tube 103 on the side of the base end 103K, there is inserted a part of a rod-shaped electric terminal shaft 109 along the axis of the sheath tube 103. A front end portion 109S of the electric terminal shaft 109 is electrically connected with a base end portion 107K of the heating coil 107 in the vicinity of the front end of the metal shell 105. Furthermore, the interior of the sheath tube 103 is filled with magnesia powder 111 or insulating powder.

When such glow plug 101 is fixed to a cylinder block of a diesel engine with a voltage being applied to the electric terminal shaft 109 from a vehicle-mounted battery as a power source, an electric current flows from the electric terminal shaft 109 to the cylinder head (or an engine block) through the heating coil 107, sheath tube 103 and metal shell 105. As a result, a high current flows to the heating coil 107 to raise its temperature, so that the sheath tube 103 is heated substantially as a whole at its portion projecting from the metal shell 105.

However, this glow plug 101 of the related art takes time to be heated to a temperature needed for preheating the diesel engine. For example, it takes around 15 seconds to heat up to about 1,000° C. the portion of the sheath tube 103 in the vicinity of the front end 103S.

The present invention has been made in view of such circumstances, and has an object to provide a glow plug, the temperature of which can be speedily raised, a structure for mounting the glow plug, and a suitable process for manufacturing the glow plug.

DISCLOSURE OF THE INVENTION

The means for solving the problem resides in a glow plug comprising: a cylindrical sheath tube closed at its front end and opened at its base end; a cylindrical metal shell covering the side of the base end of the sheath tube with the front end side portion projecting therefrom; a coil including a front end portion and a base end portion, arranged in the sheath tube along the axis thereof, and connected at its front end portion to the front end of the sheath tube; a lead member electrically connected with the coil base end portion of the coil and extending toward the base end side of the sheath tube; and insulating powder packed in the sheath tube. The front end side portion of the coil farther than the foremost end of the lead member has a coil length not larger than 15 mm in the axial direction from the front end of the sheath tube, and the sheath front end portion of the sheath tube enclosing the front end side portion of the coil has an outer diameter not larger than 4.4 mm.

In the related art glow plug, the heating coil was arranged to extend axially over substantially the whole of that portion of the sheath tube, which projects from the metal shell. Moreover, the outer diameter of the sheath tube was comparatively large. Therefore, it took long time to raise the temperature of the sheath tube up to a predetermined level.

In the invention, on the other hand, the front end side of the coil on the front end side farther than the foremost end of the lead member has the coil length L of not more than 15 mm in the axial direction from the front end of the sheath tube, and the sheath front end portion enclosing the front end portion has the outer diameter of not more than 4.4 mm. Such a coil is adapted not to heat the sheath tube as a whole with the coil but to heat only the portion of the sheath tube in the vicinity of the front end portion with the front end side portion of the coil, so that the temperature rise is attained speedily as far as the front end portion of the sheath tube is concerned. Moreover, the outer diameter of the front end portion of the sheath tube is set smaller so that the volume to be heated is reduced to accelerate the temperature rise more speedily. In short, according to the present invention, the temperature of the glow plug can be raised speedily as compared with that of a related art glow plug. Therefore, when the glow plug according to the present invention is used to preheat a diesel engine, it becomes possible to start the engine in a short period of time. For example, when a voltage of 11 V is applied to the glow plug at the room temperature, the time needed for the temperature of the portion of the outer surface of the sheath tube at the position of 2 mm in the axial direction from the front end to reach 1,000° C. is not longer than 5 seconds.

Since only that portion in the vicinity of the front end portion of the sheath which demands a high temperature (for example, 1,000° C.) is heated, moreover, the temperature of this portion rises speedily, and, after the temperature becomes high, this high level of the temperature can be controlled and maintained. Therefore, the bearing performance of the glow plug can rather be improved as compared with that of the related art glow plug in which, when an electric current is applied thereto until the front end portion of the sheath tube attains a desired temperature, the temperature of the portion (for example, the portion which is slightly closer to the base end side of the sheath tube than to the front end portion, etc.) of the sheath tube and the temperature of which rises more easily than that of the front end portion is liable to become further high.

Here, the coils herein termed so include a coil made of only a heating coil used to generate heat. The coils also include a coil, in which a heating coil arranged on the front end side of the sheath tube and having a main purpose of generating heat, and a control coil arranged in the base end side to increase a resistance value of the coil in accordance with a temperature rise and having a main purpose of restricting the quantity of electric current fed to the heating coil are arranged in series. Of these coils, the coil formed of a heating coil is preferable from the viewpoint of the necessity for accelerating the temperature rise.

When the coil made of only the heating coil is used as the coil, it is preferable that the portion of the heating coil on the front end side farther than the foremost end of the lead member has the coil length L of not more than 11 mm from the front end of the sheath tube. The reason is that the temperature rise in the front end portion of the sheath tube can be attained speedily. For example, when a voltage of 11 V is applied to the glow plug at the room temperature, the time needed for the temperature of the portion of the outer surface of the sheath tube at the position of 2 mm in the axial direction from the front end to reach 1,000° C. is not longer than 3.5 seconds.

On the other hand, it is preferable that the axial length of the heating coil on the front end side farther than the foremost end of the lead member is set not smaller than 4 mm when the heating performance is taken into consideration.

Here, the connection mode between the coil base end portion and the lead member is not especially limited. As this connection mode, there can be enumerated: a mode of winding and welding the coil closely on the outer circumference of the front end portion of the lead member; a mode of inserting a portion having a coil closely wound thereon into a recess formed in the axial direction of the lead member thereby to bond or weld the portion to the lead member; and a mode of bonding the base end of the coil to the foremost end (or the front end face) of a seed member.

The means for solving the problem also resides in the same glow plug as described above, in which the outer diameter of the sheath front end portion be preferably set to not smaller than 3.0 mm. The reason resides in the following. When the outer diameter of the front end portion of the sheath tube is set too small, the outer diameter of the coil is necessarily set small correspondingly, so that a sufficient heating performance cannot be obtained in some cases.

It is further desirable that the outer diameter of the sheath front end portion be set to 3.5 mm to 4.0 mm. The reason resides in the following. Setting the outer diameter not smaller than 3.5 mm enables the coil arranged in the inner section of the sheath front end portion to be enlarged, and a sufficient heating performance to be secured, and setting the outer diameter not larger than 4.0 mm enables a temperature rise in the sheath front end portion to be attained further speedily.

In the glow plug, moreover, from the end point of the axial front end side of a fixed portion, as fixed directly or indirectly through another member on the metal shell, of the sheath tube, to the foremost end of the lead member, a distance not smaller than 5 mm is kept toward the axial front end side.

The heat generated at the coil dissipates partially into the metal shell through the fixed portion. In this glow plug, however, there is spaced the distance between the fixed portion of the metal shell and the front end side portion of the coil on the front end side farther than the foremost end of the lead member. As compared with the structure having the short distance, therefore, the heat to dissipate into the metal shell can be relatively reduced to prevent the front end side portion of the coil and accordingly the sheath front end portion enclosing it from being delayed in the temperature rise.

Here, the fixed portion implies that portion of the sheath tube which is fixed on the metal shell. In case the base end side of the sheath tube is press-fitted, additionally fastened after inserted, or fixed without any solder in the through bore formed in the metal shell, the fixed portion is the portion which is pressed into the through bore of the metal shell. In case the base end side of the sheath tube is inserted into the through bore formed in the metal shell so that the sheath tube and the metal shell are fixed indirectly through the solder, on the other hand, the fixed portion is the portion of the sheath tube, in which the solder resides between itself and the metal shell.

Moreover, it is preferable for the glow plug that a distance not smaller than 8 mm is spaced toward the front end side in the axial direction from the end point of the front end side of the fixed portion in the axial direction to the foremost end of the lead member.

With the distance not smaller than 8 mm between the end point of the axial front end side of the fixed portion and the foremost end of the lead member 9, the heat to dissipate into the metal shell can be sufficiently reduced to prevent the resultant delay in the temperature rise sufficiently.

In any of the glow plugs described above, the lead member may have a solid rod shape having an outer diameter not smaller than 1.5 mm.

If the lead member is thin, the sheath tube is lowered in its rigidity on its base end side so that it is liable to be bent by an impact from the outside. At the manufacturing time, moreover, the sheath tube is liable to be bent at the swaging step so that the yield drops easily. Because of the thin lead member, moreover, the resistance of the lead member itself is apt to rise, and the voltage to be applied to the coil is lowered to reduce the heat generated by the coil, thereby to delay the temperature rise.

In the glow plug of the invention, on the other hand, the lead member used is the solid rod having an outer diameter not smaller than 1.5 mm. Therefore, the sheath tube is enhanced in its rigidity on the base end side so that it is prevented from being bent. Moreover, the yield at the swaging step is also enhanced. The resistance owned by the lead member can be suppressed to accelerate the temperature rise of the glow plug relatively.

In the glow plug, moreover, it is advisable that the difference between the outer diameter of the lead member and the inner diameter of the sheath tube is not smaller than 0.2 mm.

The sheath tube is highly rigid on its base end side and is reluctant to bend. Therefore, the larger outer diameter of the lead member is the more preferred. In order to secure the insulation from the sheath tube, however, it is preferable that the diameter difference be secured at least within 0.2 mm.

The means for solving the problem further resides in any one of the above-described glow plugs, in which a wall thickness of the front end portion of the sheath tube is 0.3 mm to 0.75 mm.

When the wall thickness of the front end portion of the sheath tube is set smaller than 0.3 mm, the strength of the sheath tube becomes insufficient so that it is liable to be broken by the impact of a fall. On the other hand, when the wall thickness of the front end portion of the sheath tube is set as large as not smaller than 0.75 mm, the inner diameter of the front end portion of the sheath tube becomes excessively small since the outer diameter of the front end portion of the sheath tube is set small. As a result, the outer diameter of the coil becomes unable to be secured sufficiently, so that a necessary heating performance of the coil cannot be obtained.

The glow plug according to the present invention has a wall thickness of the sheath front end portion of 0.3 mm to 0.75 mm. Therefore, it is possible to secure the strength of the sheath tube and to enlarge the outer diameter of the coil disposed in the sheath front end portion relatively, thereby to obtain a sufficient heating performance of the coil.

It is further preferable that the wall thickness of the sheath front end portion be 0.45 mm to 0.6 mm. The reason resides in the possibility of securing the strength of the sheath tube more reliably and enlarging sufficiently the outer diameter of the coil arranged in the sheath front end portion, thereby to obtain a more satisfactory heating performance.

The means for solving the problem further resides in any one of these glow plugs, in which a difference between the inner diameter of the front end portion of the sheath tube and the outer diameter of the coil is 0.2 mm to 1.6 mm.

When the difference between the inner diameter of the sheath front end portion and the outer diameter of the front end side portion of the coil is smaller than 0.2 mm, short-circuiting becomes liable to occur between the sheath front end portion and coil. On the other hand, when this difference becomes larger than 1.6 mm, the coil becomes liable to meander in the sheath front end portion, and short-circuiting likewise becomes liable to occur. Moreover, since the outer diameter of the sheath front end portion is set small, the outer diameter of the front end side portion of the coil becomes too small to obtain a necessary heating performance in some cases.

On the other hand, according to the present invention, the difference between the inner diameter of the sheath front end portion and the outer diameter of the front end side portion of the coil is within the range of 0.2 mm to 1.6 mm. Therefore, the short-circuiting rarely occurs between the front end portion of the sheath tube and the coil. Even when the outer diameter of the sheath tube is small, a satisfactorily large outer diameter of the coil can be secured, so that a necessary heating performance can be obtained.

The means for solving the problem further resides in any one of the above-described glow plugs, in which the interior of the sheath tube is filled with insulating powder with the coil front end portion being connected to the front end of the sheath tube and with the coil base end portion being drawn in the axial direction.

The interior of the sheath tube (its front end portion) is filled with insulating powder with the coil front end portion being connected to the front end of the sheath tube and with the coil being drawn in the axial direction. In such a glow plug, the coil is retained in the drawn state, so that the front end side portion of the coil farther than the foremost end of the lead member is arranged to extend straight along the axis without meandering. Therefore, short-circuiting rarely occurs between the sheath front end portion and the coil. Since the front end side portion of the coil does not meander, the outer diameter of the front end side portion of the coil is easily diametrically enlarged, and the difference between the outer diameter of the front end side portion of the coil and the inner diameter of the sheath front end portion is easily reduced.

The means for solving the problem further resides in any one of these glow plugs, in which the outer diameter of the front end side portion of the coil be preferably set to 1.5 mm to 3.0 mm.

When the outer diameter of the front end side portion of the coil is smaller than 1.5 mm, a sufficient heating performance may not be obtained in some cases. When the outer diameter of the coil exceeds 3.0 mm, the wall thickness of the sheath front end portion is necessarily reduced since the outer diameter of the sheath tube is limited, and this causes the strength of the sheath tube to become insufficient in some cases. As the outer diameter of the coil is increased, the distance between the coil and the inner surface of the sheath front end portion becomes smaller, and short-circuiting becomes liable to occur between the coil and the sheath front end portion.

On the other hand, when the outer diameter of the front end side portion of the coil is set not smaller than 1.5 mm, a sufficient heating performance can be obtained. When this diameter is set not larger than 3.0 mm, the strength of the sheath tube can be secured, and short-circuiting comes to rarely occur between the coil and the sheath front end portion.

The outer diameter of the front end side portion of the coil shall indicate the outermost one taken in a longitudinal sectional view including the center axis of the sheath tube.

The means for solving the problem further resides in any one of the above-described glow plugs, which is preferably so formed that, when a voltage of 11 V is applied to the plug at the room temperature, the time needed to have the temperature of the portion of the outer surface of the sheath tube, which is higher in the axial direction than the front end by 2 mm reach 1,000° C. is not longer than 5 seconds. The reason is that, when such a glow plug is used for preheating a diesel engine or for other purposes, the time needed to attain such a necessary temperature can be reduced.

In this plug, it is further preferable that the time needed to attain the temperature of 1,000° C. be not longer than 3.5 seconds. The reason is that the time needed to attain the temperature necessary for preheating the engine can be further reduced.

The means for solving the problem further resides in any one of the above-described glow plugs, which has a glow plug mounting structure for mounting a glow plug, with the front end side of the sheath tube projecting into the combustion chamber of a diesel engine, and the sheath front end portion projects into the combustion chamber with the front end side portion of the coil being positioned as a whole in the combustion chamber.

Generally in the diesel engine, the sheath tube of the glow plug projects on its front end side into the combustion chamber. Therefore, a mounting hole is so formed in the cylinder head at to lead to the combustion chamber, and the glow plug is mounted in that mounting hole. Depending upon the projection size of the sheath tube into the combustion chamber, the coil may be arranged partially at its front end side portion in the mounting hole. In this case, the heat generated at the front end side portion of the coil may be transferred to the cylinder head. Therefore, the heat generating characteristics of the sheath front end portion may not be exhibited in the combustion chamber.

According to the glow plug mounting structure of the invention, on the contrary, the front end side portion of the coil is so mounted in its entirety as to project without being enclosed by the cylinder head. Therefore, the heat to dissipate into the cylinder head can be suppressed to raise the temperature speedily. Moreover, most of the heat generated at the front end side portion of the coil can be utilized for heating the fuel in the combustion chamber, thereby to provide an advantage that the ignition can be efficiently assisted.

Here, the combustion chamber covers not only the main combustion chamber but also an auxiliary combustion chamber (e.g., a swirl combustion chamber or a precombustion chamber).

Especially in case the coil used has a heating coil on the front end side and a control coil arranged electrically in series and on the base end side for controlling the temperature of the heating coil, the control coil may not be cooled although the heating coil is cooled down with the blown fuel or with the swirl. In this state, the resistance value of the control coil is not lowered to limit the electric current, and the repeated temperature rise in the heating coil may be delayed. According to the present invention, on the contrary, when the sheath front end portion is cooled, the control coil is also cooled through the sheath tube surrounding it. Therefore, the resistance of the control coil drops so that the electric current to be fed to the heating coil can be increased to quicken the restoration of the temperature of the heating coil.

Moreover, the invention is especially preferred, it applied to a direct injection type diesel engine, which has such mounting structure and in which a combustion chamber is recessed in the piston. In this engine, the recessed combustion chamber in the piston is liable to limits the depth of the combustion chamber. Therefore, there is also limited the projection size of the sheath heating portion of the sheath tube of the glow plug, which is projected into the combustion chamber. In the plug of the invention, the heat is generated in a concentrated manner at the sheath front end portion of the sheath tube so that the fuel can be efficiently heated to assist the ignition efficiently even with the small projection size.

Another means for solving the problem resides in a process for manufacturing a glow plug including: a cylindrical sheath tube closed at its front end and opened at its base end; a cylindrical metal shell covering the base end side of the sheath tube with the front end side portion projecting therefrom; a coil including a front end portion and a base end portion, arranged in the sheath tube along the axis thereof, and connected at its front end portion to the front end of the sheath tube; a lead member electrically connected with the coil base end portion of the coil and extending toward the base end side of the sheath tube; and insulating powder packed in the sheath tube. The process comprises the insulating powder filling step of filling the sheath tube with the insulating powder as the lead member and the coil base end portion of the coil connected to the lead member are drawn in the axial direction with the coil front end portion of the coil being connected to the front end of the sheath tube.

According to the invention, at the insulating powder filling step, the sheath tube being filled with the insulating powder, as the lead member and the coil base end portion of the coil connected to the lead member are drawn in the axial direction with the coil front end portion of the coil being connected to the front end of the sheath tube.

When the insulating powder is thus packed in the sheath tube, the coil is arranged to extend straight along the axis of the sheath tube without meandering in the sheath tube. Therefore, short-circuiting rarely occurs between the sheath tube and the coil.

The means for solving the problem also resides in the same process for manufacturing a glow plug as described above, and the process may further comprise the swaging step of subjecting the sheath tube, which was filled with the insulating powder during the insulating powder filling step, to a swaging treatment as the lead member and the base end portion of the coil connected to the lead member are drawn in the axial direction.

According to the invention, the sheath tube filled with the insulating powder is subjected to a swaging treatment at the swaging step as the lead member and the base end portion of the coil connected to the lead member are drawn in the axial direction.

Therefore, even when the sheath tube is made to a smaller diameter, the coil is arranged straight along the axis without meandering in the sheath tube. Accordingly, short-circuiting comes to rarely occur between the sheath front end portion of the sheath tube and the heating coil.

The means for solving the problem also resides in the same process for manufacturing a glow plug as described above, in which the coil is arranged after the swaging step was carried out at the insulating material filling step, in such a manner that the front end side portion of the coil farther than the foremost end of the lead member has a coil length L not larger than 15 mm in the axial direction from the front end of the sheath tube, and in which the outer diameter of the front end side portion of the sheath tube enclosing the front end side portion of the coil is set not larger than 4.4 mm at the swaging step.

According to the invention, the coil is arranged after the swaging step was carried out in the insulating powder filling step, in such a manner that the front end side portion of the coil has a coil length L not larger than 15 mm in the axial direction from the front end of the sheath tube.

At the swaging step, moreover, the outer diameter of the sheath front end portion is set not larger than 4.4 mm.

When the coil is thus arranged at its front end side portion in the sheath front end portion with, moreover, the diameter of the sheath front end portion reduced, only the sheath front end portion of a small volume is heated in a concentrated manner without heating the sheath tube as a whole. Therefore, the temperature of this sheath front end portion can be raised speedily as compared with that of the corresponding portion formed in the related art glow plug manufacturing process. Consequently, when the glow plug thus manufactured is used to preheat the diesel engine, it becomes possible to start the engine in a short period of time.

When only the heating coil is used as the coil, it is more preferable that the front end side portion of the heating coil farther than the foremost end of the lead member has the coil length not larger than 11 mm from the front end of the sheath tube. The reason is that there can be manufactured the glow plug capable of attaining a temperature rise speedily, i.e., the glow plug in which, for example, when a voltage of 11 V is applied thereto at the room temperature, the time needed to have the portion of the outer surface of the sheath tube higher in the axial direction than the front end of the sheath tube by 2 mm reach 1,000° C. is not longer than 5 seconds.

In the swaging treatment, it is preferable that the outer diameter of the sheath front end portion be set not smaller than 3.0 mm. The reason is that, when the outer diameter of the sheath front end portion of the sheath tube is set too small, the outer diameter of the coil is necessarily set small correspondingly, so that a sufficient heating performance cannot be obtained in some cases.

BRIEF DESCRIPTION OF THE DRAWINGS

FIG. 6 is an explanatory diagram tabulating the sizes and characteristics of the glow plugs in the individual embodiments and comparative examples.

FIG. 7 is an explanatory diagram tabulating the sizes and characteristics of the glow plugs in the individual embodiments and comparative examples including the additional embodiments and comparative examples.

Figure 1:
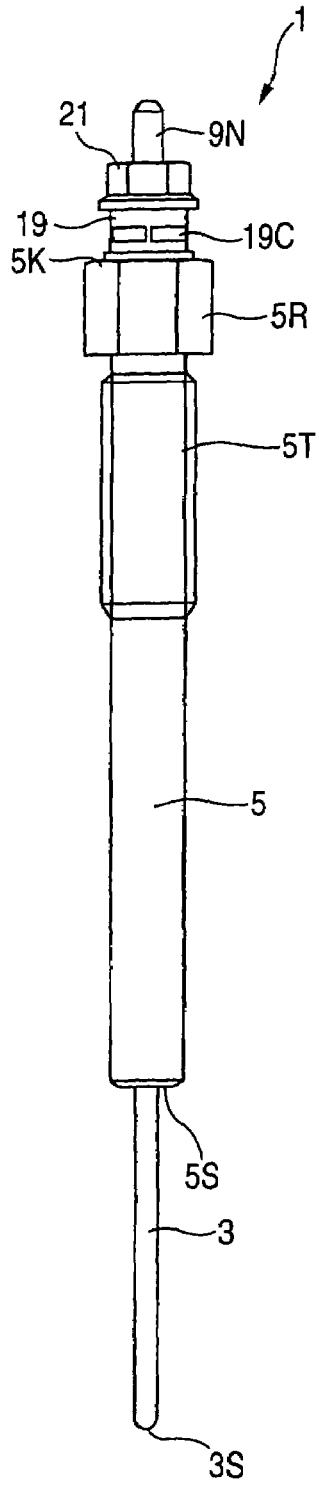
FIG. 1 is a side view showing an outer shape of a glow plug in a mode of embodiment.

In Reference Numerals and Signs: 1 . . . GLOW PLUG; 3 . . . SHEATH TUBE; 3C . . . SHEATH FRONT END PORTION; 3S . . . FRONT END (OF THE SHEATH TUBE); 3K . . . BASE END (OF THE SHEATH TUBE); 3F . . . FIXED PORTION (OF THE SHEATH TUBE); 3FT . . . END POINT (ON THE FRONT END SIDE OF THE FIXED PORTION); 3G . . . CONSTRICTED PORTION; 5 . . . METAL SHELL; 7 . . . HEATING COIL; 7S . . . COIL FRONT END PORTION; 7K . . . COIL BASE END PORTION; 7H . . . FRONT END SIDE PORTION (ON THE FRONT END SIDE OF THE COIL FARTHER THAN THE FOREMOST END OF THE LEAD MEMBER); 9 . . . ELECTRIC TERMINAL SHAFT (LEAD MEMBER); 9T . . . FOREMOST END (OF THE ELECTRIC TERMINAL SHAFT); 11 . . . MAGNESIA POWDER (INSULATING POWDER); 70 . . . SWAGING MACHINE; L . . . COIL LENGTH; L2 . . . LEAD LENGTH; D . . . OUTER DIAMETER (OF THE SHEATH FRONT END PORTION); E . . . INNER DIAMETER (OF THE SHEATH TUBE); AND H . . . OUTER DIAMETER (OF THE ELECTRIC TERMINAL SHAFT).

BEST MODE FOR CARRYING OUT THE INVENTION

EMBODIMENT 1

The modes of embodiment of the present invention will now be described with reference to the drawings. Each of the following sizes has relation to Embodiment 1 (refer to FIG. 6 and FIG. 7) of these modes of embodiment.

Figure 2:
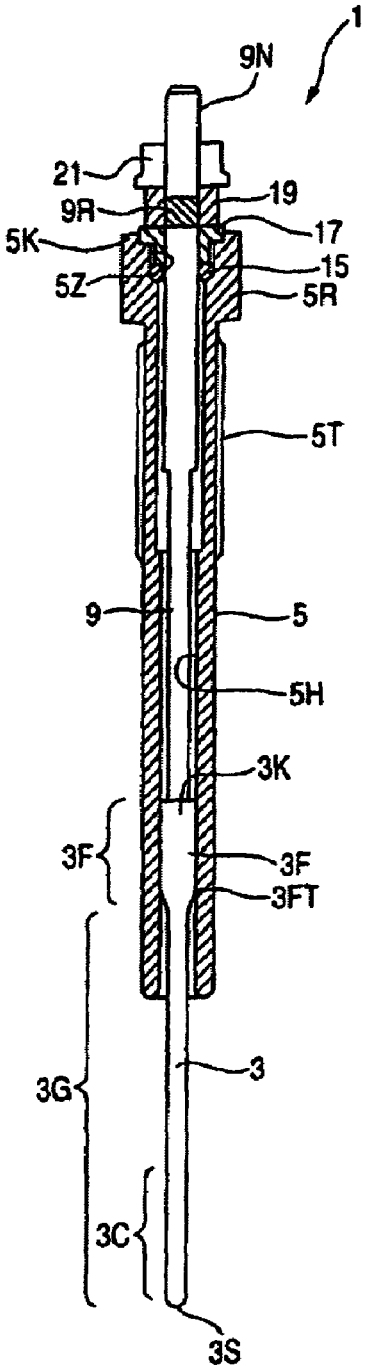
FIG. 2 is a longitudinal sectional view of the glow plug in the mode of embodiment.
Figure 3:
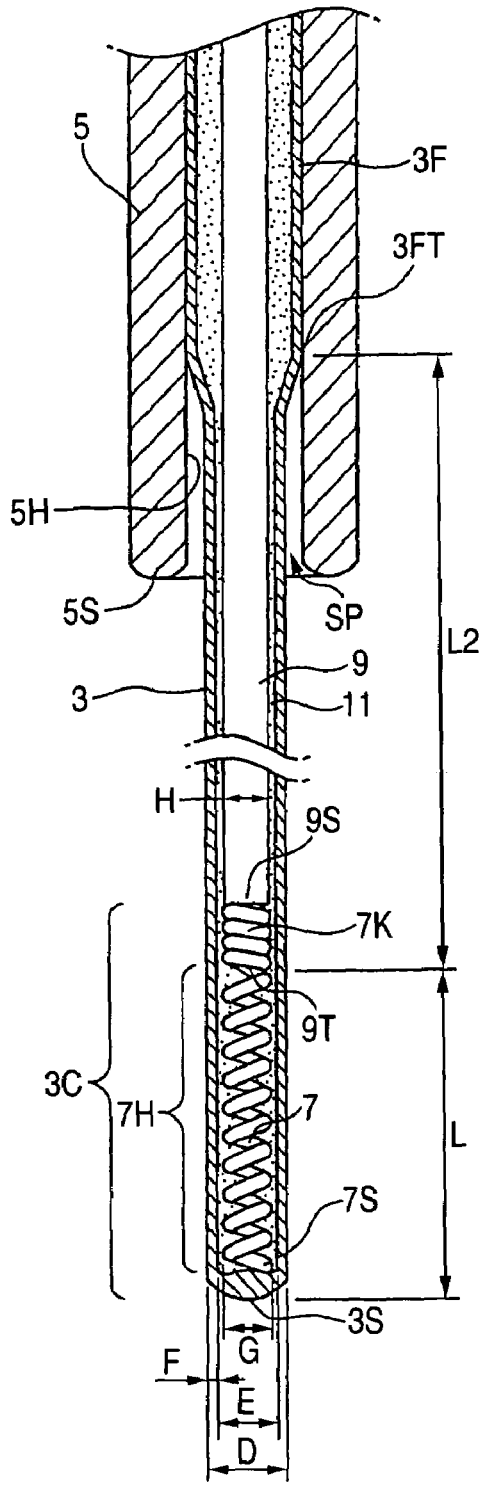
FIG. 3 is a partially enlarged sectional view of the portion of the glow plug in the mode of embodiment in the vicinity of a sheath tube.

Concerning the glow plug 1 of this mode of embodiment, a general view is shown in FIG. 1, a longitudinal sectional view in FIG. 2, and a partially enlarged sectional view of the portion in the vicinity of a sheath tube 3 in FIG. 3. This glow plug 1 is provided with a cylindrical sheath tube 3 closed at its front end (closed portion) 3S and opened at its base end 3K (open portion), and a cylindrical metal shell 5 covering the portion of this sheath tube 3 on the side of the base end 3K.

Of these parts, the sheath tube 3 is fixed and retained at its portion on the side of its base end 3K by press-fitting a later-described bulging fixed portion 3F in a through bore 5H of the metal shell 5, and projects at its portion extending from its front end 3S by about 36 mm, from a front end 5S of the metal shell 5. An outer diameter D of this projecting constricted portion 3G is at a uniform value of D=3.5 mm, and an inner diameter E of the same is at a uniform value of E=2.5 mm. Accordingly, a wall thickness F of this portion is at a uniform value of F=0.5 mm. At the portion of the sheath tube 3 which is positioned in the through bore 5H of the metal shell 5, the outer diameter and inner diameter are enlarged to have the bulging fixed portion 3F having a larger diameter than that of the front end side. At the fixed portion 3F in the vicinity of the base end 3K, the outer diameter is 4.4 mm, and the inner diameter 3.3 mm. In this mode of embodiment, an end point 3FT of the fixed portion 3F on the front end side (on the lower side of the Drawings) is positioned on the base end side (on the upper side of the Drawings) farther than the front end 5S of the metal shell 5, thereby to form a ring-shaped space SP between the through bore 5H and the constricted portion 3G.

In the interior of the sheath tube 3, a heating coil 7 adapted to generate heat when an electric current is supplied to the glow plug is arranged along its axis, as shown in FIG. 3. This heating coil 7 is provided with a base end portion 7K and a front end portion 7S. The coil base end portion 7K is used to be connected to an electric terminal shaft 9, as will be hereinafter, and to make a portion which does not generate heat even when energized. Of this heating coil 7, on the other hand, the portion of the front end side (on the lower side of the Drawings) farther than the foremost end 9T of the electric terminal shaft 9 is formed by turning a conductor in a coil shape. Of this heating coil 7, the front end side portion 7H (as will be called the "coil heating portion 7H") is arranged in a sheath front end portion 3C, specifically, in the portion of a distance L=11 mm from the front end 3S of the outer circumference of the sheath tube 3 to the foremost end 9T. In short, the coil heating portion 7H has a size of the distance L=11 mm, as metered from the front end 3S of the outer circumference of the sheath tube 3, in the axial direction.

The front end portion 7S of the heating coil 7 is electrically connected to the front end 3S of the sheath tube 3 by welding. This heating coil 7 is formed of an iron-chromium alloy wire. A nickel-chromium alloy wire and the like can also be used. This heating coil 7 has a diameter of the wire of 0.25 mm, and an outer diameter G of 1.9 mm, a winding pitch of 0.7 mm and the number of turns of the wire of 10. Therefore, a difference between an inner diameter E of the sheath front end portion 3C and the outer diameter G of the heating coil 7 is 0.6 mm. The distance L mentioned above will also hereinafter be referred to simply as a coil length L.

In the interior of the sheath tube 3, a lead member, in concrete terms, the solid rod type electric terminal shaft 9 is inserted along the axis of the sheath tube 3. A front end portion 9S of the electric terminal shaft 9 has a stepped constricted projection (although not shown) and is electrically connected with the base end portion 7K of the heating coil 7 by welding. The electric terminal shaft 9 projects from a base end portion 5K of the metal shell 5 through the metal shell 5 to the base end side (to the upper side of the Drawings). A male thread is formed in the outer circumference of this projecting portion to form a male thread portion 9N. In this mode of embodiment, the foremost end (corresponding to the front end face in this mode of embodiment) of that small projection provides the foremost end 9T of the electric terminal shaft 9.

Moreover, the interior of the sheath tube 3 is filled with magnesia powder (insulating powder) 11. To be concrete, the magnesia powder 11 is packed in the sheath tube 3 with the front end portion 7S of the heating coil 7 being connected to the front end 3S of the sheath tube 3 and with the base end portion 7K of the heating coil 7 and the electric terminal shaft 9 being drawn in the axial direction to the base end side (upward of the Drawings).

The metal shell 5 is provided on the side of its base end portion 5K with a cross-sectionally hexagonal tool engaging region SR, with which a tool such as a wrench and the like is to be engaged when the glow plug 1 is fixed to a diesel engine, and on the immediately front side of the tool engaging region SR with a glow plug fixing threaded section ST.

The base end portion 5K of the metal shell 5 is provided with a countersunk section 5Z in the through bore 5H. In this countersunk section 5Z, there are fitted a rubber O-ring 15 and an insulating nylon bush 17 fitted around the electric terminal shaft 9. Moreover, a ferrule 19 for preventing the insulating bush 17 from coming off is mounted on the insulating bush 17. The ferrule 19 is fixed to the electric terminal shaft 9 by caulked portions 19C formed on the outer circumference of the ferrule 19. The surface of the electric terminal shaft 9, to which the ferrule 19 is opposed, is provided with a knurled portion 9R, the outer circumference of which is knurled so as to enhance the caulk-bonding power. A nut 21 is a part for fixing a power supplying electric cable to the electric terminal shaft 9.

Figure 4:
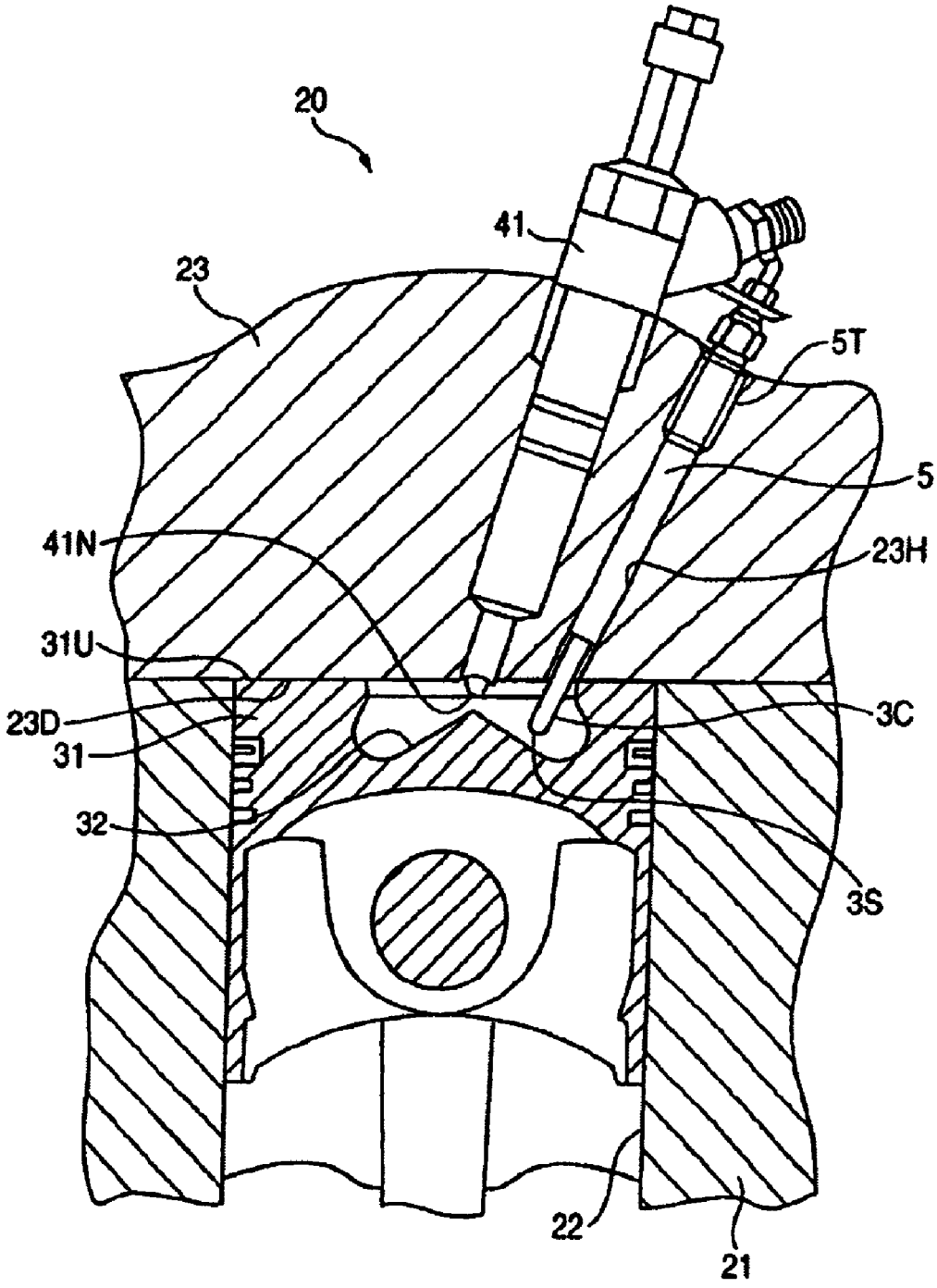
FIG. 4 is an explanatory view of the state, in which the glow plug in the mode of embodiment is mounted in a direct injection type diesel engine.
Figure 5:
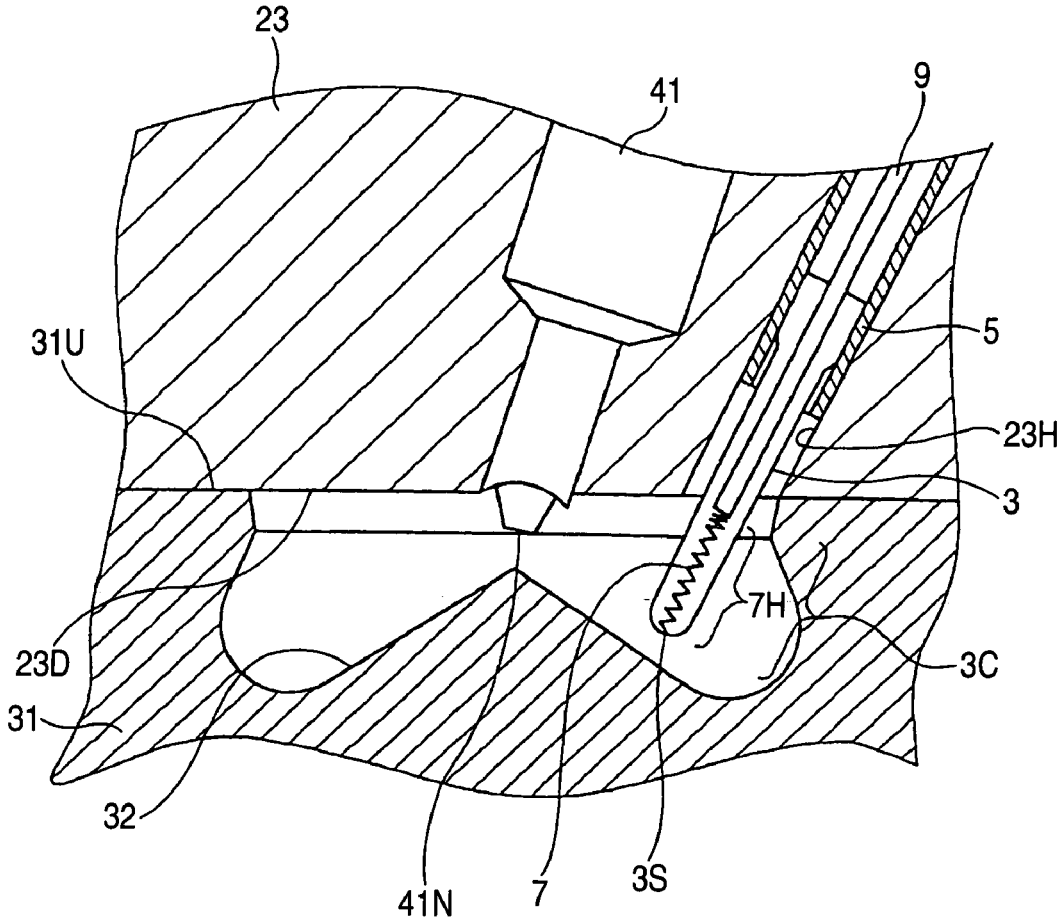
FIG. 5 is a partially enlarged explanatory view for explaining the relation between the coil of the glow plug and a combustion chamber in the state shown in FIG. 4.

Here will be described (refer to FIG. 4 and FIG. 5) the power supply to the glow plug and the characteristics at the power supply when the glow plug 1 is mounted in a diesel engine 20.

This diesel engine 10 is composed of: a cylinder block 21 having a cylinder 22; a cylinder head 23 for closing the cylinder; and a piston 31 moving reciprocally upward and downward in the cylinder 22. This diesel engine 20 is a direct injection type diesel engine. A combustion chamber 32 is formed in the recessed upper face 31U of the piston 31, and a fuel is atomized from a nozzle 41N at the front end of a fuel atomizing device 41. The glow plug 1 is fixed in a mounting hole 23H, which is formed in the cylinder head 23 of the diesel engine 20, by using the fitting threaded section 5T of the metal shell 5. As a result, the sheath front end portion 3C housing the heating coil 7 is positioned in the combustion chamber 32 of the engine 20. Specifically, the entirety of the sheath front end portion 3C, that is, the entirety of the coil heating portion 7H of the heating coil 7 is arranged to project from the lower face 23D of the cylinder head 23 so that the coil heating 7H is positioned in its entirety in the combustion chamber 32.

In case the invention is applied to the engine of the type having a main combustion chamber and an auxiliary combustion chamber unlike this embodiment, the sheath front end portion 3C and the coil heating portion 7H of the glow plug 1 are positioned in the auxiliary combustion chamber.

When a voltage is applied from a vehicle-mounting battery as a power source, to the electric terminal shaft 9, an electric current flows from the electric terminal shaft 9 through the heating coil 7, the sheath tube 3 and the metal shell 5 to the cylinder head 23. As a result, a large current flows to the heating coil 7 in the inner portion of the sheath tube 3, so that the temperature of the front end portion 3C rises speedily. After the temperature of the sheath front end portion 3C rises to a predetermined level (for example, 1,000° C.), the temperature of the heating coil 7 is maintained at a substantially predetermined level by chop-controlling the applied voltage. By atomizing the fuel from the nozzle 41 of the fuel atomizing device 41 while the sheath front end portion 3C being thus heated, the ignition of the fuel is assisted so that the engine is started by the combustion of the fuel.

It was ascertained that the glow plug 1 of this Embodiment 1 had such features that, when an electric voltage of 11 V was applied to the glow plug at the room temperature by using a constant voltage power source, the time needed to attain the temperature of the section of the outer surface of the sheath front end portion 3C at the position higher by 2 mm than the front end of the sheath tube reach 1,000° C. was only 3.2 seconds (refer to FIGS. 6 and 7).

In such a glow plug 1, the coil heating portion 7H (i.e., the front end side portion of the front end side farther than the foremost end 9T of the electric terminal shaft 9) of the heating coil 7 is arranged in the front end portion 3C of the sheath tube 3. Therefore, unlike the related art glow plug in which, when a voltage is applied to the glow plug 1, the projecting portion as a whole of the sheath tube 3 is heated, only the section of the sheath tube 3 demanding a high temperature in the vicinity of the front end portion 3C of the sheath tube 3 is heated in this embodiment. Therefore, it is considered that a rise in the temperature of this sheath front end portion 3C comes to be attained speedily. Moreover, since the diameter of the sheath front end portion 3C is set comparatively small, the volume of the portion of the sheath tube to be heated further decreases, and it is considered that this also contributed to the speedy temperature rise.

To be concrete, the coil heating portion 7H of the heating coil 7 in this Embodiment 1 is arranged in the sheath front end portion 3C which extends from the front end of the sheath tube 3 to the portion of L=11 mm. In short, the coil length of the coil heating portion 7H is L=11 mm. Moreover, the outer diameter D of the sheath front end portion 3C is set to 3.5 mm. Namely, the coil heating portion 7H of the heating coil 7 in this Embodiment 1 is arranged in the sheath front end portion extending from its front end upward by within 15 mm, and more preferably within 11 mm. Moreover, the outer diameter D of the sheath front end portion 3C is set smaller than 4.4 mm, and more preferably smaller than 4.0 mm, so that the volume of the portion of the sheath tube to be heated is reduced. Therefore, it is considered that the temperature rise in the sheath front end portion comes to be attained speedily. As compared with the related art glow plug, the glow plug 1 of Embodiment 1 is capable of having the temperature of the sheath front end portion 3C, which needs to have a high temperature, and rises speedily up to a predetermined level, so that the engine can be started in a short period of time.

In this Embodiment 1, the coil heating portion 7H of the heating coil 7 is arranged in the portion of the sheath tube 3, which extends from its front end to the portion higher by L=11 mm than the sheath front end, as mentioned above, and a length not smaller than L=4 mm is secured. Moreover, the outer diameter D of the sheath front end portion 3C is set to 3.5 mm, and the outer diameter of not smaller than 3.0 mm and more preferably not smaller than 3.5 mm is thereby secured. Thus, the size G (1.9 mm to be exact) of the outer diameter G of the portion of the heating coil 7 held in the sheath front end portion 3C is secured. Owing to these dimensional features, a sufficient heat generating performance of the heating coil 7 is obtained.

In Embodiment 1, the wall thickness F of the front end portion 3*c* of the sheath tube 3 is 0.5 mm, which is within the range of 0.3 to 0.75 mm, and within the more preferable range of 0.45 to 0.6 mm. Therefore, it is possible to secure a sufficient strength of the sheath tube 3, and a sufficiently large outer diameter G of the heating coil 7 arranged in the sheath tube 3, and to obtain a sufficient heat generating performance.

The difference between the inner diameter E of the front end portion 3C of the sheath tube 3 and the outer diameter G of the coil heating portion 7H of the heating coil 7 is 0.6 mm; which is within the range of 0.2 mm to 1.6 mm. Namely, since this difference is as large as not smaller than 0.2 mm, the short-circuiting rarely occurs between the front end portion 3C of the sheath tube and the heating coil 7. Since the difference mentioned above is not larger than 1.6 mm, the outer diameter G of the coil heating portion 7H of the heating coil 7 can be set sufficiently large even when the outer diameter D of the sheath front end portion 3C is small. Therefore, a necessary heat generating performance can be obtained.

The interior of the sheath tube 3 is filled with the magnesia powder 11 with the heating coil 7 being drawn in the axial direction together with the electric terminal shaft 9. Therefore, the heating coil 7 is arranged in the front end portion 3C of the sheath tube 3 without meandering therein, and short-circuiting comes to rarely occur between the sheath front end portion 3C and the heating coil 7. This structure is also capable of easily increasing the outer diameter G of the heating coil 7, and setting smaller the difference between the outer diameter G of the coil heating portion 7H of the heating coil 7 and the inner diameter E of the sheath front end portion 2C.

In this Embodiment 1, the outer diameter G of the coil heating portion 7H of the heating coil 7 is 1.9 mm, which is within the range of 1.5 mm to 3.0 mm. Accordingly, a sufficient heat generating performance can be obtained since the outer diameter G is not smaller than 1.5 mm, and the strength of the sheath tube 3 can be secured since the same outer diameter is not larger than 3.0 mm. Moreover, short-circuiting comes to rarely occur between the heating coil 7 and sheath tube 3.

Moreover, a space SP is formed between the metal shell 5 and the constricted portion 3G of the sheath tube 3, and the distance (or lead length) L2 in the axial direction from the end point 3FT on the front end side of the fixed portion 3F, which is radially enlarged and fixed in the metal shell 5, to the foremost end 9T of the electric terminal shaft 9 is 8.0 mm, which is not smaller than 5.0 mm. Therefore, the heat generated in the coil heating portion 7H is prevented from dissipating through the fixed portion 3F of the sheath tube 3 into the metal shell 5 to delay the temperature rise in the sheath front end portion 3C.

In addition, the electric terminal shaft 9 has the solid rod shape of the outer diameter H of 2.0 mm, which is not smaller than 1.5 mm. Therefore, the rigidity on the base end side of the sheath tube 3 is retained to prevent the sheath tube 3 from being bent by an impact from the outside. At the time of manufacturing the glow plug 1, moreover, the defect of bending the sheath tube is also prevented at the step of the swaging treatment. In addition, the electric terminal shaft 9 is thick enough to suppress its resistance to a low level, and the voltage to be applied to the coil heating portion 7H is raised to raise the temperature speedily.

On the other hand, the diameter difference between the outer diameter H (=2.0 mm) of the electric terminal shaft 9 and the inner diameter E (=2.5 mm) of the sheath tube 3 is 0.5 mm, which is not smaller than 0.2 mm. Thus, it is also possible to keep the insulation between the sheath tube 3 and the electric terminal shaft 9.

EMBODIMENTS 2 TO 5 AND COMPARATIVE EXAMPLES 1 AND 2

Glow plugs 1 of Embodiments 2 to 5 which had substantially the same shape and construction as those of the above-described embodiment 1, and which had various coil lengths L, outer diameters (outer diameters of front end portions of sheath tubes) D of sheath front end portions 3C, normal temperature resistance values, and the like were manufactured. In addition, a glow plug 1 for Comparative Example 1 in which the coil length L was enlarged, and a glow plug 1 for Comparative Example 2 in which the outer diameter D of a front end portion was enlarged were manufactured. The characteristics of temperature rise, the time needed to attain the temperature of 1,000° C. and the endurance cycle number of these glow plugs were examined. Here, the normal temperature resistance is the resistance of the glow plug at the room temperature (of 25° C.). The attainable time T (in seconds) of 1,000° C. is the time period, for which the outer surface temperature, as measured by a thermocouple, of the sheath tube at the position of 2 mm in the axial direction from the front end attains 1,000° C. after a DC voltage DCV=11V was applied by using a constant voltage power source. Moreover, the endurance cycle number is the cycle number measured till the coil is broken, by repeating one cycle composed of the period (one minute), for which the DC voltage DCV=13.5 V is chop-supplied at the duty ratio corresponding to each glow plug, and the power-off (broken) period (one minute), so that the outer surface temperature of the sheath tube at the position of 2 mm in the axial direction from the front end may be stabilized at 950° C. after the start of the power supply. Moreover, similar investigations were performed by manufacturing glow plugs 1 for Embodiments 6 to 8, which had the lead length L2 and a varied outer diameter H of the electric terminal shaft, a glow plug 1 for Comparative Example 3, in which the coil length L was enlarged and in which the outer diameter of the electric terminal shaft was reduced, and a glow plug 1 for Comparative Example 4, in which the coil length L was enlarged and in which lead length L2 was reduced.

The material of which the heating coils 7 in all of these glow plugs are made is an iron-chromium alloy wire. The winding pitch of the coils is 0.7 mm, and the diameter of the wires of the coils is 0.25 mm, the outer diameter G of the coils being 1.9 mm. However, the outer diameters G of the coils in Embodiment 5 and Comparative Example 2 are set to 2.5 mm and 2.6 mm, respectively. The wall thickness F of the front end portions 3C of the sheath tubes 3 was set to 0.5 mm but the wall thickness F in Embodiment 5 and Comparative Example 2 was set to 0.55 mm and 0.8 mm, respectively. Accordingly, the difference (E−G) between the inner diameter E of the sheath tube and the outer diameter G of the coil is 0.6 mm, but this difference in both Embodiment 5 and Comparative Example 2 is 0.8 mm.

The normal temperature resistance value R of the glow plugs 1 were obtained by measuring the resistance values of the glow plugs 1 with a resistance meter in the environment of the normal temperature (at 25° C.).

The characteristics of temperature rise of each glow plug were obtained by recording temperature variation occurring while a DC voltage of 11 V was applied to each glow plug 1 to have the temperature then reach 1,000° C. as the temperature of the outer surface of the portion of the sheath tube at a distance of 2 mm higher in the axial direction than its front end 3S was measured with a thermocouple. The time needed to attain the temperature of 1,000° C. is the time elapsed until 1,000° C. was attained.

The endurance tests were then conducted, in which a combination of a one-minute period for chop-supplying a DC voltage of 13.5 V to each glow plug in accordance with a duty ratio suited to the glow plug so that the temperature of the outer surface of the portion of the sheath tube 3 at 2 mm higher in the axial direction than its front end 3S became stable at 950° C. after the start of the supply of the mentioned voltage, and a one-minute period for cutting off (interrupting) the supply of the voltage was determined as one cycle, this cycle being repeated. The endurance cycle number was obtained by counting the cycle number recorded until the breakage of the coil occurred in this endurance test.

Figure 8:
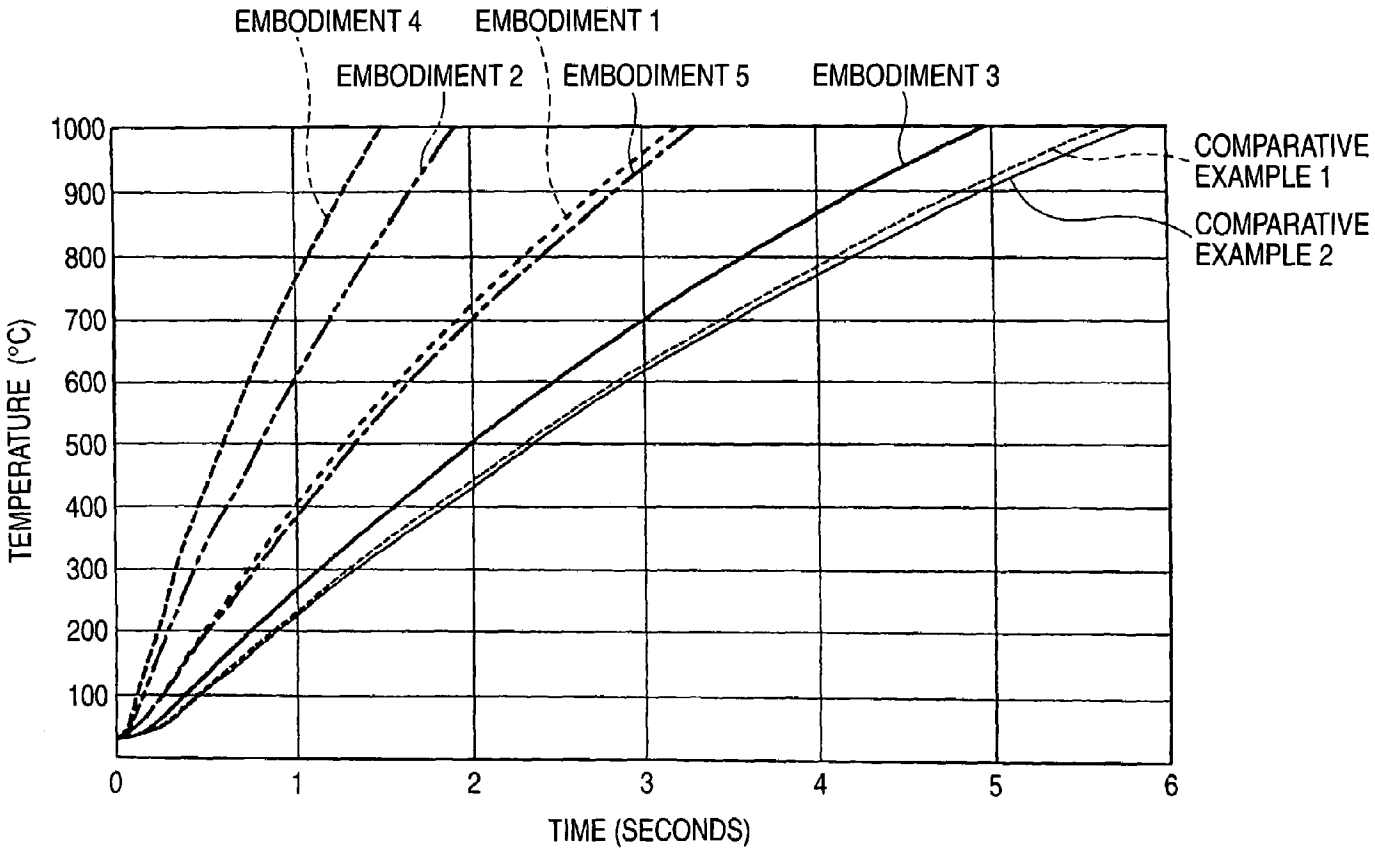
FIG. 8 is a graph presenting the temperature rising characteristics of the glow plugs in the individual embodiments.

The results of these tests including those of the experiment on the glow plug 1 of Embodiment 1 are shown in FIG. 6 to FIG. 8. However, the temperature rise characteristics are not plotted in FIG. 8 for Embodiments 6 to 8 and Comparative Examples 3 and 4.

Figure 9:
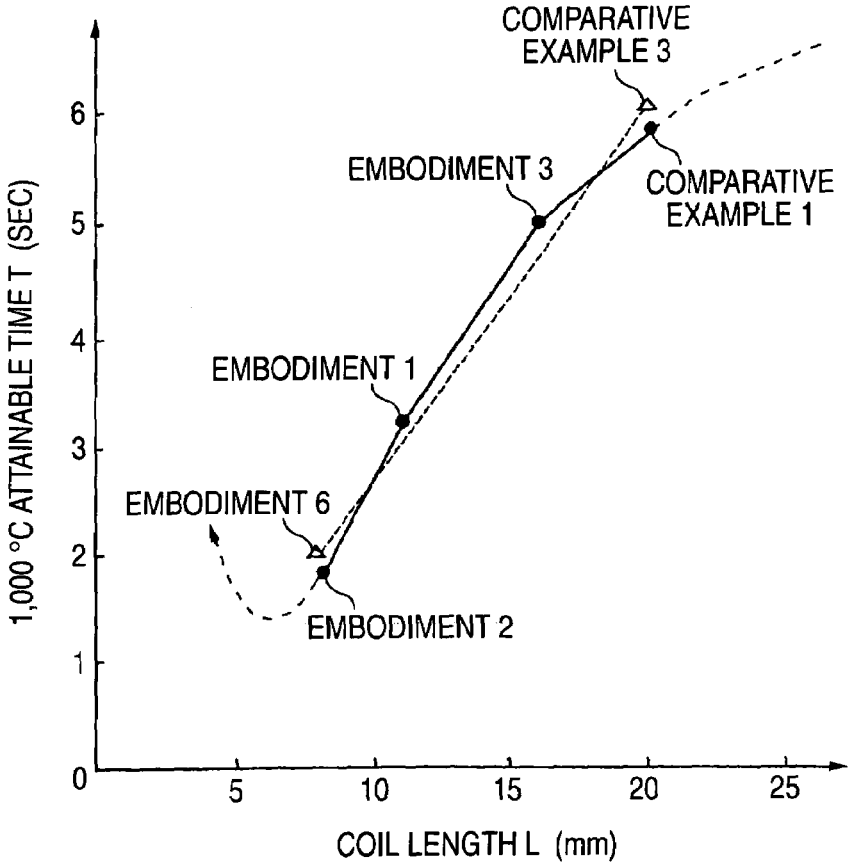
FIG. 9 is a graph presenting relations between a coil length L and an attainable time T of 1,000° C. of the characteristics of the embodiments and comparative examples shown in FIGS. 7 and 8.
Figure 10:
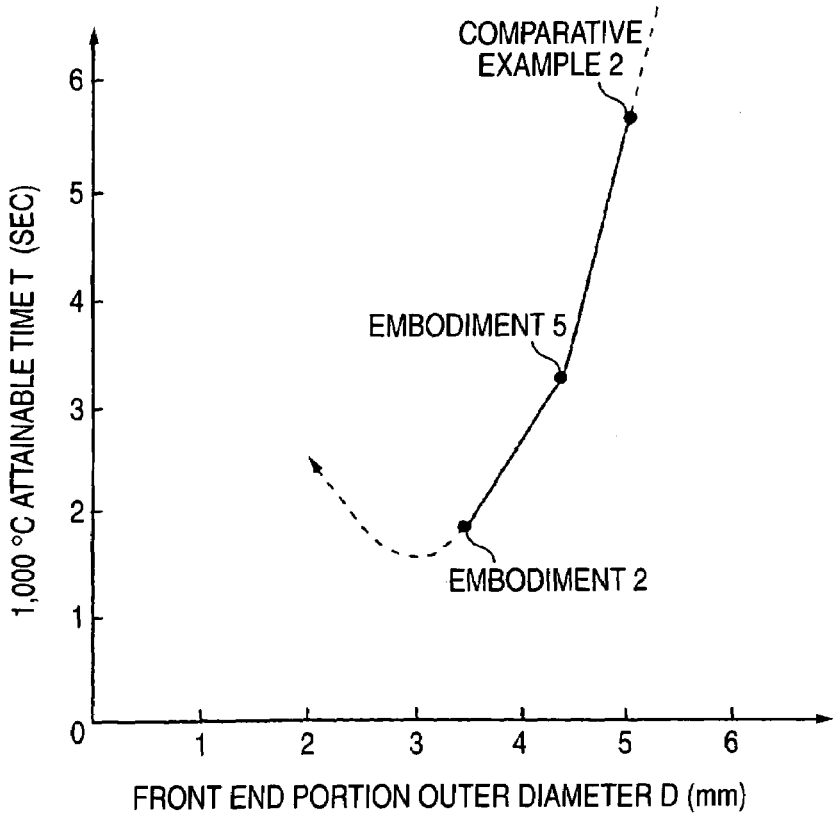
FIG. 10 is a graph presenting relations between a front end portion outer diameter D and the attainable time of 1,000° C. of the characteristics of the embodiments and comparative examples shown in FIGS. 7 and 8.

As the results of the individual Embodiments and Comparative Examples, moreover, the relations between the coil length L and the attainable time T of 1,000° C. are plotted in FIG. 9, and the relations between the external diameter D of the sheath front end portion 3C and the attainable time T of 1,000° C. are plotted in FIG. 10.

It is understood from the results of the tests on the glow plugs of Embodiments 1, 2 and 3 and Comparative Example 1 that, as the coil length L decreases, the characteristics of temperature rise become better to enable the temperature of the coil to rise speedily. To be more concrete, in the test on the glow plug of Comparative Example 1 in which L=20 mm, the time needed to attain 1,000° C. was T=5.8 seconds, while, in the test in which L=15 mm (Embodiment 3), the time needed to attain the same temperature was T=5.0 seconds, i.e., not longer than 5 seconds can be attained. Furthermore, when L=11 mm (Embodiment 1), the time needed to attain 1,000° C. is T=3.2 seconds, i.e., not longer than 3.5 seconds can be attained. When L=8 mm (Embodiment 2), the time needed to attain 1,000° C. can be reduced to a level of as short as T=1.9 seconds. Since the heating coil 7 is arranged in a concentrated manner in the portion of the sheath tube 3 which demands a high temperature, and which is in the vicinity of the front end 3S of the sheath tube 3, the sheath front end portion 3C is heated in a concentrated manner. This is similar to the relation between Embodiment 6 and Comparative Example 3, in which the electric terminal shaft 9 has an outer diameter of H=1.0 mm, and the temperature can be more speedy for the smaller coil length L. It is understood by comparing the gradient between the point of Embodiment 3 and the point Comparative Example 1 and the gradient between the point of Embodiment 3 and the point of Embodiment 1 in the graph of FIG. 9 that the contribution of the coil length L to the reduction in the attainable time T of 1,000° C. is high for the coil length not larger than L=15 mm.

If the coil length L is extremely small, the calorific value drops. It is, therefore, considered that the attainable time T of 1,000° C. is elongated in the region of the short coil length L, as shown by a dotted line in FIG. 9.

It is also understood that the endurance cycle number becomes larger, i.e., the lifetime of the glow plug becomes longer as the coil length L becomes smaller. It is presumed that the reason for this resides in the following. Namely, when the coil length L is large, not only the portion of the sheath tube of 2 mm from the front end 3S thereof or close to the front end but also the portion of the sheath tube extending up to the base end section is heated. In this case, the portion of the outer surface of the sheath tube, the temperature of which becomes the highest, is the portion which is still closer to the base end, i.e., higher than the portion (which will hereinafter be referred to also as the temperature measuring point), which is at the position of 2 mm from the front end 3S. In short, it is comparatively difficult that the temperature of the portion (temperature measuring point) of the sheath tube, which is at 2 mm higher than the front end 3S rises. Therefore, when an electric current is applied to the glow plug so that the temperature measuring point attains a desired temperature, the temperature of the portion at the base end becomes still higher. As a result, the heating coil 7 becomes liable to be broken. On the other hand, when the coil length L is small, a distance between the portion (temperature measuring point) of the sheath tube at 2 mm from the front end 3S and the portion of the highest temperature decreases, and the difference in the temperature also decreases. Accordingly, it is considered that, even when an electric current is applied to the glow plug so that the temperature of the temperature measuring point reaches a desired temperature, the temperature of a part of the heating coil 7 does not become too high, and that the breakage of the wire comes to rarely occur.

It is further understood from the results of the experiments in Embodiments 2 and 5 and Comparative Example 2 that, as the outer diameter D of the sheath front end portion 3C decreases the characteristics of temperature rise of the sheath tube becomes superior. To be concrete, in Comparative Example 2 of D=5.0 mm, the time needed to attain a temperature of 1,000° C. was T=5.7 seconds, while, when D=4.4 mm (Embodiment 5), T=3.3 seconds. When D=3.5 mm (Embodiment 2), the time could be reduced to as short as T=1.9 seconds. It is considered that reducing the diameter of the sheath front end portion 3C enabled the volume to be heated to become smaller, and that the temperature rise was thereby speedy.

If the outer diameter D of the sheath front end portion becomes extremely small, however, the calorific value at the heating coil 7 is reduced. It is considered that the attainable time T of 1,000° C. rises in the region of the small outer diameter D, as indicated by a broken line in FIG. 10.

It is also understood that the endurance cycle number becomes larger, i.e., the lifetime of the glow plug becomes longer as the outer diameter D of the sheath front end portion 3C becomes smaller. It is presumed that the reason for this resides in the following. Namely, when the outer diameter D is large, the area of heat dissipation becomes relatively large. Therefore, it is considered that, when the temperature of the temperature measuring point on the surface of the sheath tube is set to a desired level, the temperature of the heating coil 7 is further higher. This eventually causes the heating coil 7 to become liable to be broken. On the other hand, when the outer diameter D is small, the heat dissipation is small, so that a difference between the temperature of the temperature measuring point and the temperature of the heating coil 7 becomes small. Accordingly, it is considered that, even when an electric current is applied to the glow plug so that the temperature of the temperature measuring point becomes equal to a desired temperature, the temperature of the heating coil 7 does not become too high, and that the breakage of the wire comes to rarely occur.

When Embodiments 2 and 4 are compared with each other, it is understood that the embodiment having a lower normal temperature resistance value R has excellent characteristics of temperature rise. It is considered that the reason why the temperature of the sheath tube increases more speedily is that, when the normal temperature resistance value R is low, the making power becomes high.

By comparing the results of Embodiment 2 and Embodiment 7, Embodiment 6 and Embodiment 8, and Comparative Example 1 and Comparative Example 4, moreover, it is understood that the temperature rising characteristics are the better for the larger lead length L2. To be concrete, Embodiments 7 and 8 for L2=3.0 mm had the attainable times of 1,000° C. of T=3.6 seconds and T=3.7 seconds, respectively. The attainable times of Embodiments 2 and 6 for L2=8.0 mm could be shortened to T=1.9 seconds and T=2.0 seconds. It is considered that the calorific value to dissipate into the metal shell 5 through the sheath fixed portion 5 could be suppressed by enlarging the lead length L2, thereby to accelerate the temperature rise.

In the change from Embodiment 2 to Embodiment 7, moreover, the attainable time T of 1,000° C. could be shortened to 1.7 seconds (=3.6−1.9) by enlarging the lead length L2 from 3.0 mm to 8.0 mm. Likewise in the change from Embodiment 6 to Embodiment 8, the attainable time T of 1,000° C. could be shortened to 1.7 seconds (=3.7−2.0) by enlarging the lead length L2 from 3.0 mm to 8.0 mm. In the change from Comparative Example 1 to Comparative Example 4, on the contrary, the attainable time T of 1,000° C. could be shortened only to 0.7 seconds (=6.5−5.8). From this, it is understood that the effect (to improve the temperature rising characteristics) of enlarging the lead length L2 is the more prominent for the smaller coil length L. In short, it is understood that the temperature rising characteristics become the better for the smaller coil length L and for the larger lead length L2.

The process for manufacturing the glow plug 1 will now be described.

First, the heating coil 7 and the electric terminal shaft 9 are prepared. The base end portion 7K of the heating coil 7 and the small-diameter projection (although not shown) of the front end portion 9S of the electric terminal shaft 9 are connected together by welding.

The sheath tube 3 is then prepared. This sheath tube 3 has a constant outer diameter of 5.15 mm. The heating coil 7 and the electric terminal shaft 9 are inserted from the front end portion 7S of the heating coil 7 into a hollow portion of the sheath tube 3, and the front end portion 7S of the heating coil 7 and the front end 3S of the sheath tube 3 are connected together by welding.

Figure 11:
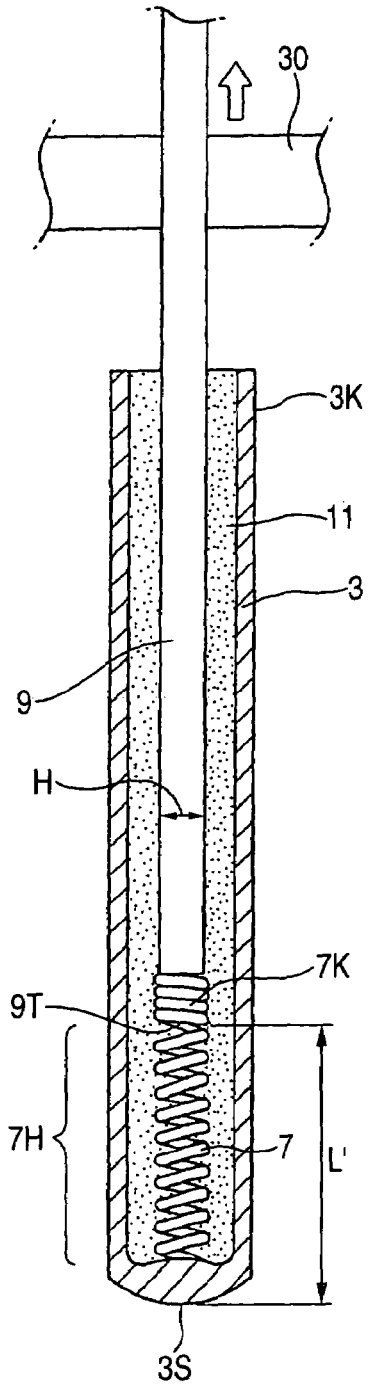
FIG. 11 is an explanatory view showing an insulating powder filling step of packing magnesia powder in a sheath tube in the process for manufacturing the glow plug in a mode of embodiment.

Then, at the insulating powder filling step, the interior of the sheath tube 3 is filled with the magnesia powder 11 as the heating coil 7 and the electric terminal shaft 9 are drawn in the axial direction, as shown in FIG. 11. To be concrete, the electric terminal shaft 9 is grasped by a plurality of chucks 30, which are adapted to move back and forth freely, for example, from the outer side of the axis of the electric terminal shaft 9 toward the same axis. The magnesia powder 11 is packed in the interior of the sheath tube 3 as the heating coil 7 and the electric terminal shaft 9 are drawn in the axial direction (upward in the drawing) of the terminal shaft 9 by those plural chucks 30. At this step, the heating coil 7 is arranged after the later-described swaging step was carried out, by adjusting a coil length L' before worked, such that the front end side portion 7H of the heating coil 7 farther than the foremost end 9T of the electric terminal shaft 9, that is, the coil heating portion 7H is positioned in the sheath front end portion 3C extending from the front end 3S of the outer circumference of the sheath tube 3 in the axial direction by not larger than L=15 mm (L=11 mm in Embodiment 1).

After this, a seal ring (not shown) such as a rubber O-ring and the like is arranged in an annular hollow clearance around the portion of the electric terminal shaft 9 in an opening of the base end 3K of the sheath tube 3, and the magnesia powder 11 is sealed in the hollow portion of the sheath tube 3. Since the seal ring is arranged in the opening of the base end 3K of the sheath tube 3, the occurrence of spill of the magnesia powder 11 during the swaging step, as will be described later is prevented.

Figure 12:
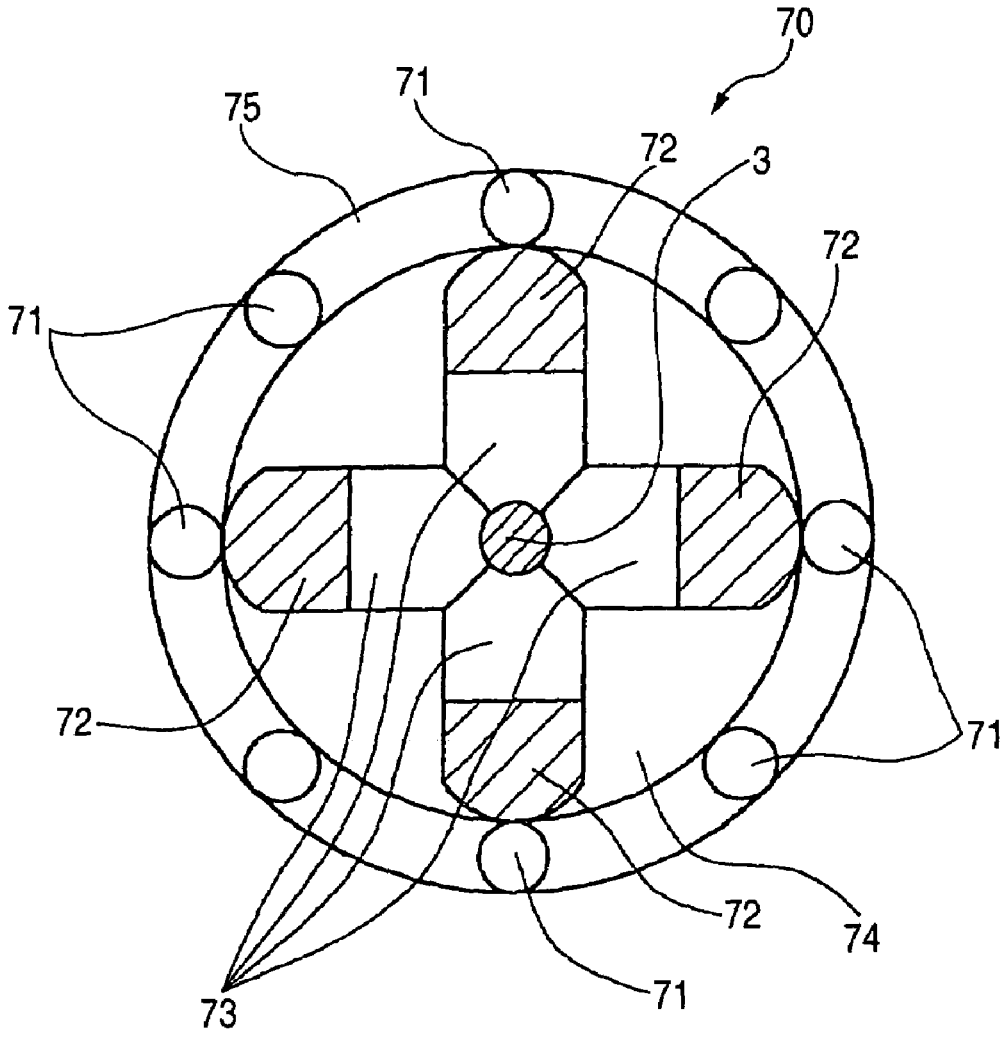
FIG. 12 is an explanatory view showing an essential portion of a swaging machine for carrying out a swaging treatment in the process for manufacturing the glow plug in a mode of embodiment.
Figure 13:
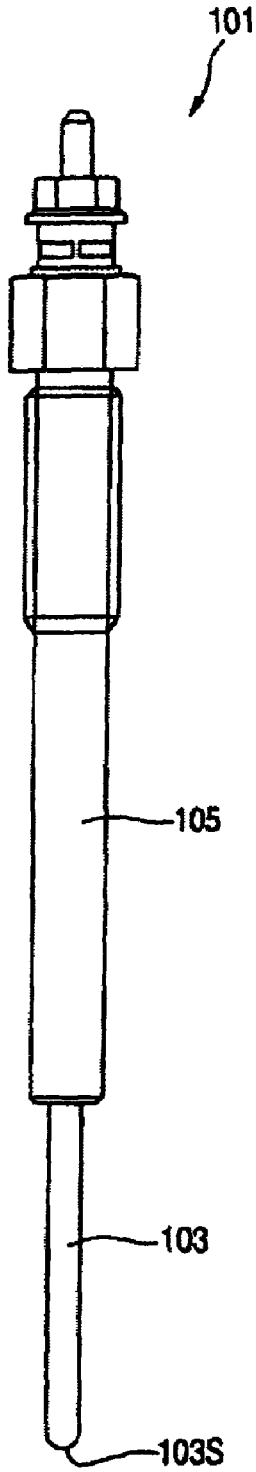
FIG. 13 is a side view showing an outer shape of a glow plug in the related art.
Figure 14:
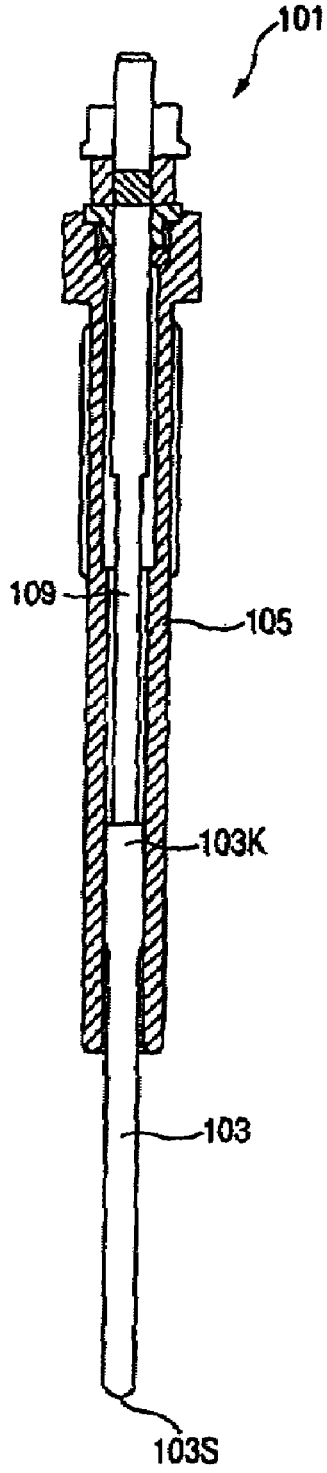
FIG. 14 is a longitudinal sectional view of the glow plug in the related art.
Figure 15:
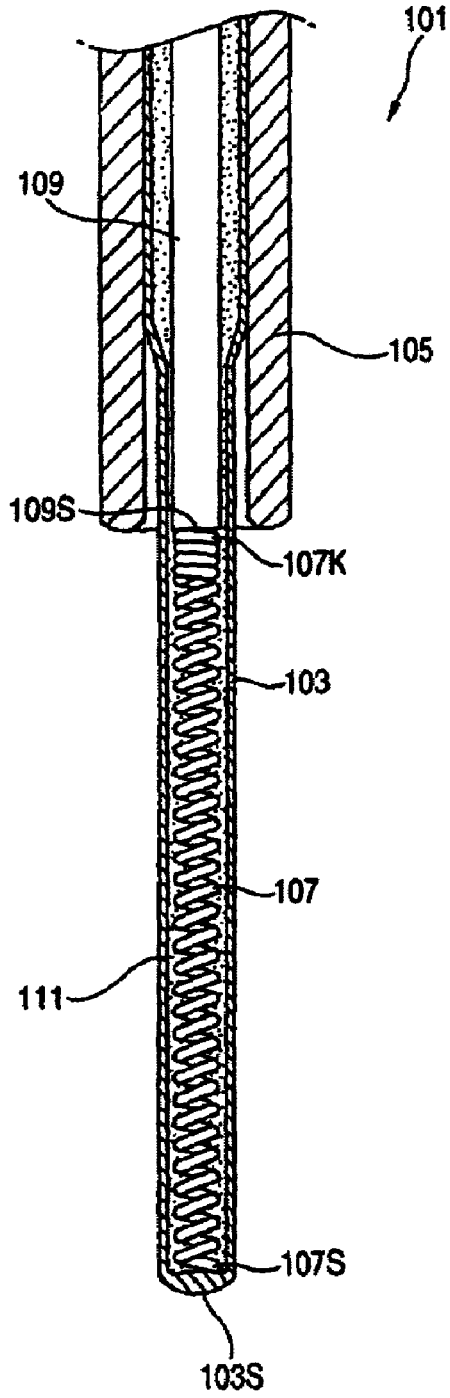
FIG. 15 is a partially enlarged sectional view of the portion of the glow plug in the related art mode in the vicinity of the sheath tube.

Next, at the swaging step, a swaging treatment is carried out by a swaging machine 70 shown in FIG. 12. In this swaging machine 70, a plurality of forging dies 73 arranged to surround the sheath tube 3 are supported on respectively corresponding hammers 72, and these parts are arranged in a main rotary shaft 74 and rotated in one body. This main rotary shaft 74 is adapted to be rotated on the inner side of a gauge 75 having a plurality of rollers 71 made of hardened steel and the like. When the hammers 72 come to the positions of the rollers 71 as the hammers are rotated with the main rotary shaft 74, the forging dies 73 are compressed, so that, when the hammers 72 are moved to positions between the adjacent rollers 71 and 71, the forging dies 73 are opened by a centrifugal force. Accordingly, when the speed of the main rotary shaft 74 is raised to a level not lower than a predetermined level, a compression treatment in the radial direction by the forging dies 73 from the outer circumference of the sheath tube 3 can be carried out repeatedly any number of times.

During this swaging treatment, the portion of the electric terminal shaft 9 projecting from the base end 3K of the sheath tube 3 is grasped by the plural chucks (not shown) which can be moved back and forth, for example, from the outer side of the axis of the terminal shaft toward the same axis. The swaging treatment is carried out as the electric terminal shaft 9 and the heating coil 7 are drawn in the axial direction by those plural chucks.

At this swaging treatment, the sheath tube 3 may be formed in a curved shape, in case the electric terminal shaft 9 has a small outer diameter H. It is presumed that the reason for this resides in the following. Namely, because of the thin electric terminal shaft 9, the portion (close to the base end of the sheath tube 3) of the sheath tube 3, in which the electric terminal shaft 9 is inserted, has such a low rigidity that the sheath tube 3 is shaped with a curve. It can be confirmed that the sheath tube 3 was curved after the swaging treatment in the glow plugs 1 of Embodiments 6 and 8 and Comparative Example 3, when the electric terminal shaft 9 of H=1.0 mm was used. However, this bend is not so serious as to make the assembly of the sheath tube 3 difficult, but raises no problem when the assembly is used as the glow plug. In other Embodiments and other Comparative Examples, on the contrary, no bend was found in the sheath tube 3 after swaged. From this, it is found preferable that the electric terminal shaft 9 is thickened to enhance the rigidity of the sheath tube 3, and that the outer diameter is not smaller than H=1.5 mm.

The fixing metal member 5 is then prepared, and the electric terminal shaft 9 is inserted from the opening of the front end 5S into the through bore 5H, and the sheath tube 3 is then press-fitted and fixed in the fixing metal member.

The O-ring 15 is thereafter fitted in the countersunk section 5Z formed in the base end portion 5K of the fixing metal member 5, and the insulating bush 17 is further fitted therein. The ferrule 19 is further fixed on the insulating bush by caulking. The nut 21 is fixed on the ferrule.

Thus, the glow plug 1 is completed.

According to the process for manufacturing a glow plug described above, the magnesia powder 11 is packed in the sheath tube 3 at the insulating powder filling step as the base end portion 7K of the heating coil 7 as well as the electric terminal shaft 9 is drawn in the axial direction with the front end portion 7*s* of the heating coil 7 being fixed on the front end 3S of the sheath tube 3 by welding. Therefore, the heating coil 7, to which a tensile force is exerted, is arranged in the sheath tube 3 along the axis without meandering therein, and a clearance can be secured reliably between the sheath tube 3 and heating coil 7. Accordingly, even when the diameter of the sheath tube 3 is reduced at a later swaging step, short-circuiting comes to rarely occur between these two parts.

The heating coil 7 is arranged such that the front end side portion 7H of the heating coil 7 on the front end side farther than the foremost end 9T of the electric terminal shaft 9, that is, the coil heating portion 7H may take a coil length L not more than 15 mm in the axial direction from the front end 3S of the sheath tube 3. Therefore, when a voltage is applied to the glow plug, the section of the sheath tube 3 in the vicinity of the front end portion 3C comes to be heated in a concentrated manner without heating the portion as a whole of the sheath tube 3 projecting from the metal shell 5. This enables the temperature of the sheath front end portion 3C to be speedily raised as compared with that in the related art glow plug. Accordingly, when the glow plug 1 manufactured in the above-described manner is used for preheating a diesel engine, the engine can be started in a short period of time.

In this mode of embodiment, the sheath tube 3 filled with the magnesia powder 11 is subjected to a swaging treatment at the swaging step as the base end portion 7K of the heating coil 7 is drawn in the axial direction. Therefore, even when the diameter of the sheath tube 3 is reduced, the heating coil 7 is arranged in the sheath tube 3 (or its front end portion 3C) without causing the coil to meander therein. Accordingly, short-circuiting rarely occurs between the sheath front end portion 3*c* and the heating coil 7.

Although the present invention has been described in detail and with reference to its specific modes of embodiments, it is apparent to those skilled in the art that various modifications and corrections could be added without departing the spirit and scope of the invention.

The present application is based on Japanese Patent Application (JP-2001-185196) filed on Jun. 19, 2001, the contents of which are herein incorporated as the reference.

INDUSTRIAL APPLICABILITY

The present invention has been described above in conformity with Embodiments 1 to 8 and Comparative Examples 1 to 4. However, the present invention should not be limited to these embodiments and the like, and could, of course, be utilized by making suitable modifications thereon without departing from the gist of the invention.

For example, an iron-chromium alloy is used as the material for the heating coil 7 in each of the above embodiments. The heating coil may also be formed by using some other material, such as a nickel-chromium alloy and the like.

In these embodiments, the heating coil 7 only is shown as the coil provided in the sheath tube 3. A coil of a combination of a heating coil and a control coil can also be provided in the sheath tube by connecting to a base end side portion of the heating coil in series the control coil, the resistance value of which increases in accordance with a temperature rise, adapted to restrict an electric current.

Even in the case of using the coil having the control coil and the heating coil thus connected in series, moreover, the sheath front end side enclosing the front end side portion may project into the combustion chamber, such that the front end side portion of the coil on the front end side farther than the foremost end of the electric terminal shaft (or the lead member). It is presumed that the reason for this resides in the following. The control coil is cooled together with the heating coil by the injection or swirl of the fuel. Therefore, the resistance in the control coil drops so that the electric current is increased to increase the heat generated in the heating coil thereby to restore the temperature at the sheath front end portion speedily.

What is claimed is:

1. A glow plug comprising:

a cylindrical sheath tube closed at its front end and opened at its base end;

a cylindrical metal shell covering the side of said base end of said sheath tube with the side of said front end projecting therefrom;

a coil including a front end portion and a base end portion, arranged in said sheath tube along an axis thereof, and connected at said front end portion to said front end of said sheath tube;

a lead member connected with said base end portion of said coil and extending toward the side of said base end of said sheath tube; and insulating powder packed in said sheath tube, wherein a front end side portion of said coil farther than a foremost end of said lead member has a coil length L not larger than 15 mm in an axial direction from said front end of said sheath tube, a sheath front end portion of said sheath tube enclosing said front end side portion of said coil has an outer diameter not larger than 4.4 mm, wherein a distance from an end point of an axial front end side of a fixed portion where said sheath tube is fixed directly or indirectly through another member on said metal shell, to said foremost end of said lead member, is not smaller than 5 mm toward said axial front end side, and wherein said lead member has a solid rod shape having an outer diameter not smaller than 1.5 mm.

2. The glow plug according to claim 1, wherein a wall thickness of said sheath front end portion of said sheath tube is 0.3 mm to 0.75 mm.

3. The glow plug according to claim 1, wherein a difference between an inner diameter of said sheath front end portion of said sheath tube and an outer diameter of said front end side portion of said coil is 0.2 mm to 1.6 mm.

4. The glow plug according to claim 1, wherein the interior of said sheath tube is filled with insulating powder with said front end portion of said coil being connected to said front end of said sheath tube and with said base end portion of said coil being drawn in an axial direction.

5. A glow plug mounting structure for mounting a glow plug according to claim 1, with the side of said front end of said sheath tube projecting into a combustion chamber of a diesel engine, wherein said sheath front end portion projects into said combustion chamber with said front end side portion of said coil being positioned as a whole in said combustion chamber.

6. A process for manufacturing a glow plug including:

a cylindrical sheath tube closed at its front end and opened at its base end;

a cylindrical metal shell covering the side of said base end of said sheath tube with the side of said front end projecting therefrom; a coil including a front end portion and a base end portion, arranged in said sheath tube along an axis thereof, and connected at said front end portion to said front end of said sheath tube;

a lead member connected with said base end portion of said coil and extending toward the side of said base end of said sheath tube; and insulating powder packed in said sheath tube, the process comprising:

an insulating powder filling step of filling said sheath tube with said insulating powder as said lead member and said base end portion of said coil connected to said lead member are drawn in an axial direction with said front end portion of said coil being connected to said front end of said sheath tube.

7. The glow plug manufacturing process according to claim 6, further comprising:

a swaging step of subjecting said sheath tube, which was filled with said insulating powder during said insulating powder filling step, to a swaging treatment as said lead member and said base end portion of said coil connected to said lead member are drawn in an axial direction.

8. The glow plug manufacturing process according to claim 7, wherein said coil is arranged after said swaging step was carried out at said insulating material filling step, in such a manner that a front end side portion of said coil farther than a foremost end of said lead member has a coil length L not larger than 15 mm in an axial direction from said front end of said sheath tube, and an outer diameter of a sheath front end portion of said sheath tube enclosing said front end side portion of said coil is set not larger than 4.4 mm at said swaging step.

9. A glow plug comprising:

a cylindrical sheath tube closed at its front end and opened at its base end;

a cylindrical metal shell covering the side of said base end of said sheath tube with the side of said front end projecting therefrom;

a coil including a front end portion and a base end portion, arranged in said sheath tube along an axis thereof, and connected at said front end portion to said front end of said sheath tube;

a lead member connected with said base end portion of said coil and extending toward the side of said base end of said sheath tube; and insulating powder packed in said sheath tube, wherein a front end side portion of said coil farther than a foremost end of said lead member has a coil length L not larger than 15 mm in an axial direction from said front end of said sheath tube, a sheath front end portion of said sheath tube enclosing said front end side portion of said coil has an outer diameter not larger than 4.4 mm, wherein said lead member has a solid rod shape having an outer diameter not smaller than 1.5 mm, and a glow plug mounting structure for mounting a glow plug with the side of said front end of said sheath tube projecting into a combustion chamber of a diesel engine, and wherein said sheath front end portion projects into said combustion chamber with said front end side portion of said coil being positioned as a whole in said combustion chamber.

10. A glow plug comprising:

a cylindrical sheath tube closed at its front end and opened at its base end;

a cylindrical metal shell covering the side of said base end of said sheath tube with the side of said front end projecting therefrom;

a coil including a front end portion and a base end portion, arranged in said sheath tube along an axis thereof, and connected at said front end portion to said front end of said sheath tube;

a lead member connected with said base end portion of said coil and extending toward the side of said base end of said sheath tube; and insulating powder packed in said sheath tube, wherein a front end side portion of said coil farther than a foremost end of said lead member has a coil length L not larger than 15 mm in an axial direction from said front end of said sheath tube, a sheath front end portion of said sheath tube enclosing said front end side portion of said coil has an outer diameter not larger than 4.4 mm, and wherein the interior of said sheath tube is filled with insulating powder with said front end portion of said coil being connected to said front end of said sheath tube and with said base end portion of said coil being drawn in an axial direction.

11. A glow plug comprising:

a cylindrical sheath tube closed at its front end and opened at its base end;

a cylindrical metal shell covering the side of said base end of said sheath tube with the side of said front end projecting therefrom;

a coil including a front end portion and a base end portion, arranged in said sheath tube along an axis thereof, and connected at said front end portion to said front end of said sheath tube;

a lead member connected with said base end portion of said coil and extending toward the side of said base end of said sheath tube; and insulating powder packed in said sheath tube, wherein a front end side portion of said coil farther than a foremost end of said lead member has a coil length L not larger than 15 mm in an axial direction from said front end of said sheath tube, a sheath front end portion of said sheath tube enclosing said front end side portion of said coil has an outer diameter not larger than 4.4 mm, wherein said lead member has a solid rod shape having an outer diameter not smaller than 1.5 mm, and wherein an outer diameter of said lead member and an inner diameter of said sheath tube is not less than 0.2 mm.

12. The glow plug according to claim 1, wherein a difference between said outer diameter of said lead member and an inner diameter of said sheath tube is not smaller than 0.2 mm.

* * * * *